US005860224A

United States Patent [19]

Larson

[11] Patent Number: 5,860,224

[45] Date of Patent: Jan. 19, 1999

[54] TESTING FOR BLOCKED DRYER VENT

[76] Inventor: Eric K. Larson, 42 King Philip Rd., Narragansett, R.I. 02882

[21] Appl. No.: 867,606

[22] Filed: Jun. 2, 1997

[51] Int. Cl.[6] ..... F26B 7/00

[52] U.S. Cl. ..... 34/418; 34/606; 34/607

[58] Field of Search ..... 34/606, 607, 418

[56] References Cited

U.S. PATENT DOCUMENTS

| | | | |
|---|---|---|---|
| 4,380,126 | 4/1983 | Kinder | 34/607 |
| 4,989,347 | 2/1991 | Kretchman | 34/607 |

*Primary Examiner*—Ronald Capossela

[57] ABSTRACT

A test instrument inserted into a filter access port of a clothes dryer blocks air flow through the port and has a sensor which senses a pressure difference between its front and back faces. A display responsive to the sensor gives indication of whether the dryer's vent is

3 Claims, 4 Drawing Sheets

TESTING FOR BLOCKED DRYER VENT

BRIEF SUMMARY OF THE INVENTION

The invention relates to testing a clothes dryer installation to ascertain whether it has a blocked exhaust vent, and particularly for such as have a dryer with a port on the top surface for insertion and removal of a lint filter.

In many service calls to fix inoperative clothes dryers, service personnel need to ascertain whether the exhaust vent of the dryer is blocked. The vent is often ,not easily accessible and test equipment is difficult to connect. The present invention provides apparatus and method for easily testing for vent blockage. According to the invention, a service person replaces a lint filter accessible through a top surface port with a test instrument. The instrument senses a pressure difference between its front and back faces and displays an indication of whether the dryer's vent is blocked.

DETAILED DESCRIPTION

Figure 1:
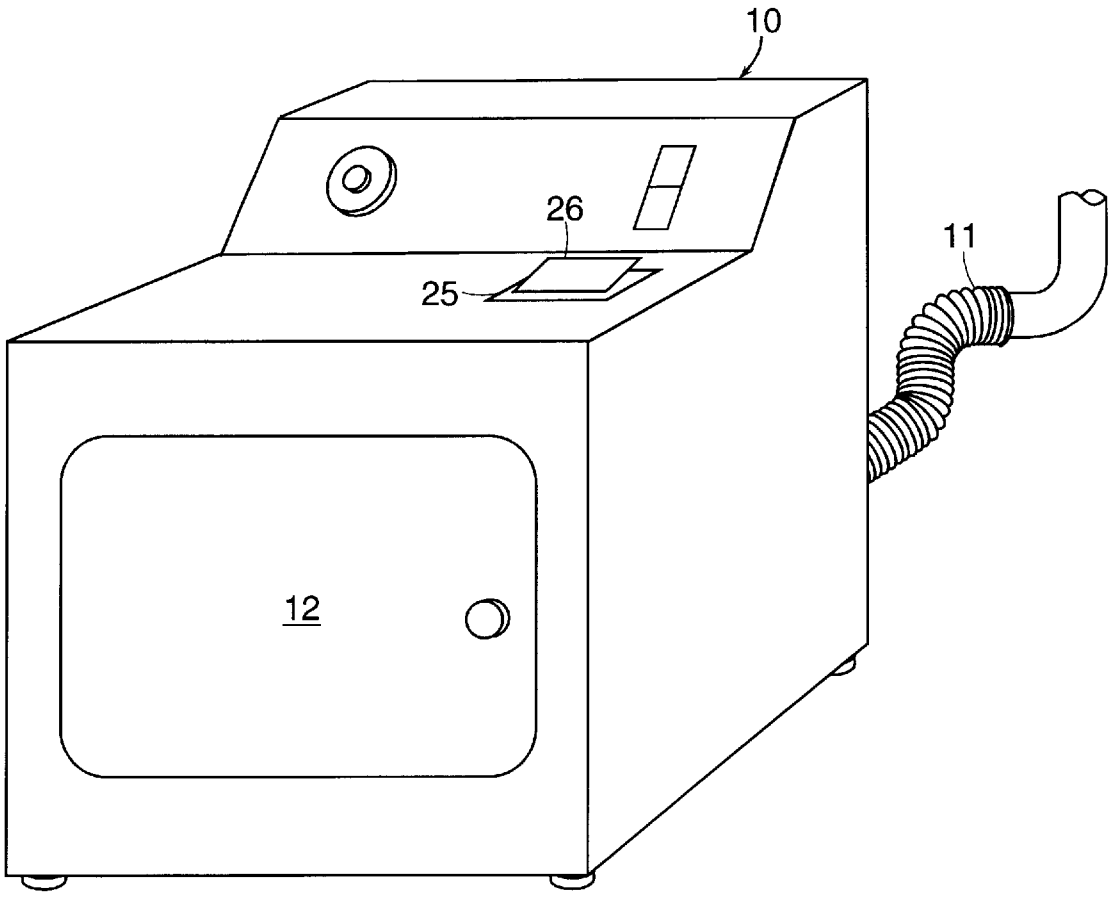
FIG. 1 shows a clothes dryer employing a test instrument according to the invention.
Figure 2:
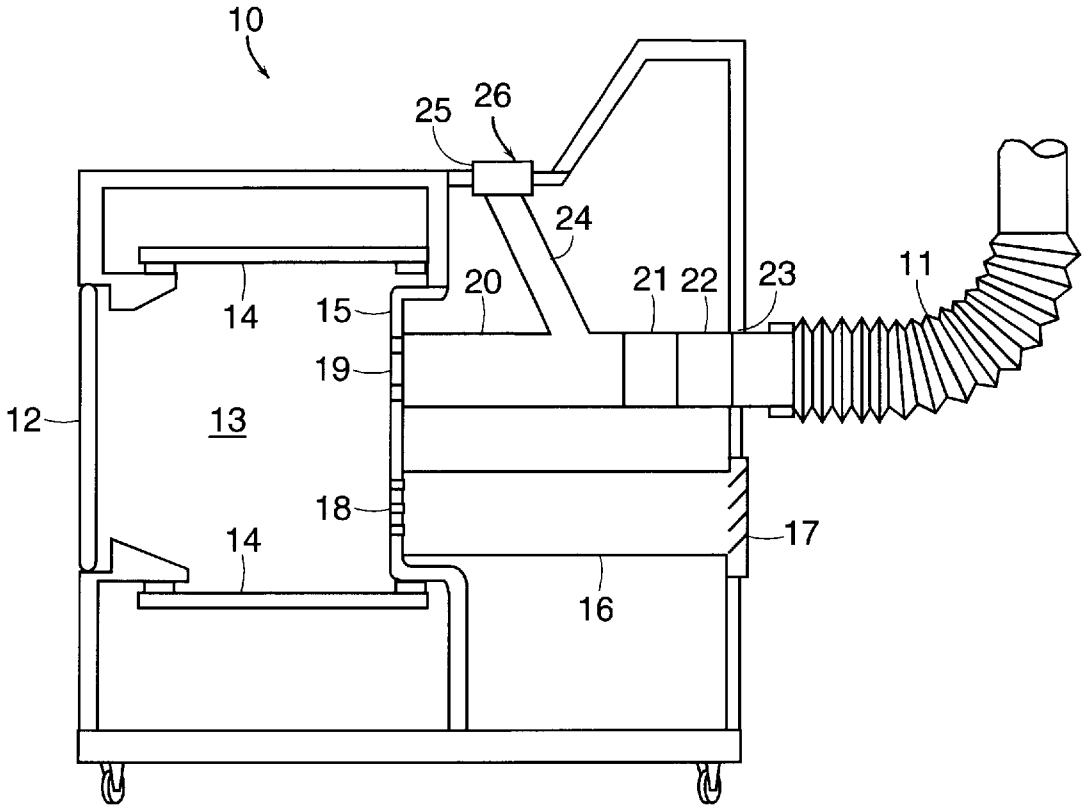
FIG. 2 shots partly schematically the air passages of the dryer of FIG. 1.

The invention may be described more particularly with reference to the Figures. Clothes dryer 10 has an exhaust discharged through vent 11 which is typically a permanently installed tube connected to the back of the dryer with a length of flexible tubing. Dryer 10 has door 12 giving access to clothes chamber 13 enclosed by rotating drum 14 and back plate 15. Duct 16 connects intake opening 17 to back plate 15 where perforations 18 admit air into chamber 13. Perforations 19 in back plate 15 let air flow from chamber 15 into duct 20 which connects to blower 21 connected in turn to duct 22, exhaust port 23 and vent 11. Lint filter removal passage 24 connects duct 20 to filter access port 25 on the top of dryer 10. In normal operation, that is to say when the installation is not being tested for vent blockage, a lint filter assembly is inserted into passage 24 through port 25 so as to close port 25 and interpose a filter in the air path between duct 20 and blower 21. When testing for vent blockage according to the invention, the filter assembly is removed from passage 24 and port 25 and test instrument 26 is emplaced in port 25.

Figure 3:
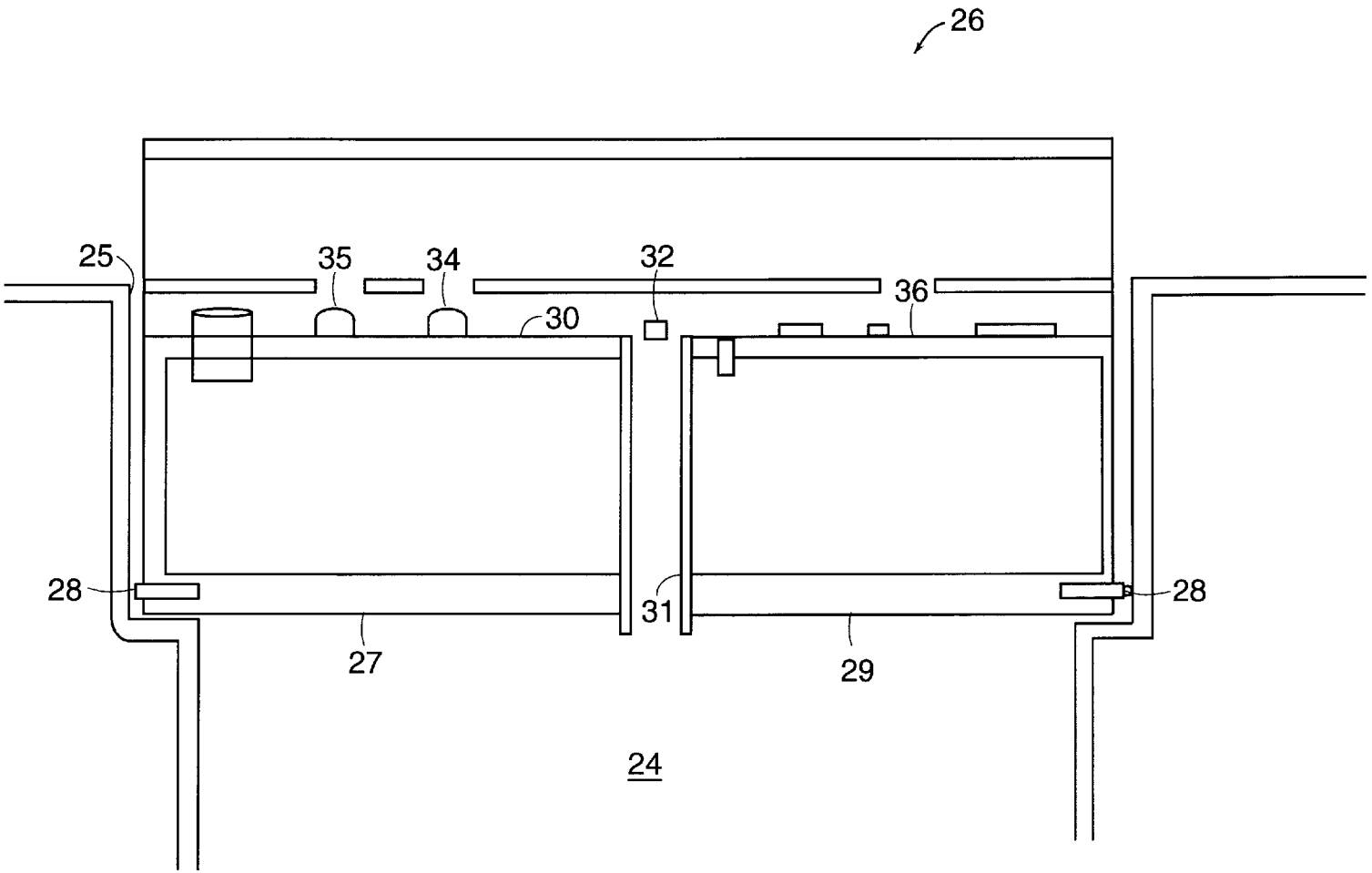
FIG. 3 :shows the test instrument of FIG. 1 in greater detail.
Figure 4:
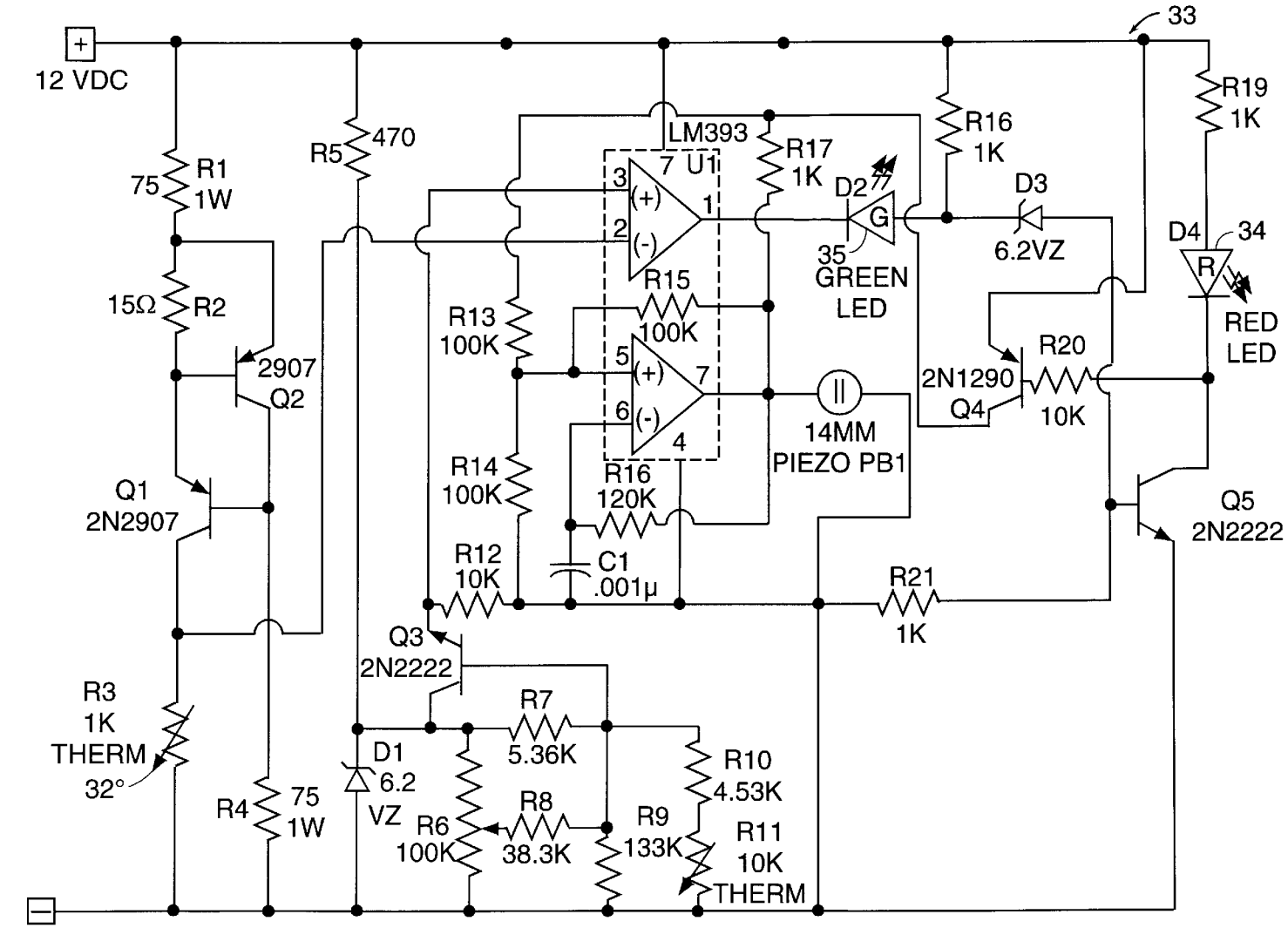
FIG. 4 shows schematically circuitry which is part of the test instrument.

Test instrument 26, as shown particularly in FIG. 3 installed in port 25, includes body 27 with peripheral seal 28 which engages port 25 and cooperating with body 27 seals and prevents ambient air from entering passage 24. Passage face 29 of body 27 thus faces into passage 24 and feels the air pressure therein. Ambrose face 30 of body 27 faces outward and feels the ambient pressure. Test passage 31 traverses body 27 from passage face 29 to ambient face 30. Thermistor 32 is placed in test passage 31 where it will be in the stream air passing through test passage 31. Thermistor 32 is connected to circuitry 33, as shown particularly in FIG. 4, which includes signal light 34 and signal light 35 all mounted on board 36.

Operation of the test procedure is as follows. A service person wishing to ascertain whether the exhaust vent of a dryer is blocked pulls the filter assembly out from port 25 and inserts test instrument body into port 25 so that passage face 23 faces into passage 29, ambient face 30 faces outward, and seal 28 engages port 25. The circuitry 26 is then powered, which heats thermistor 32, and the dryer is turned on, which runs blower 21 and moves air through the dryer. If there is no blockage in vent 11, the pressure difference between passage 24 and ambient will have some value which can be designated a normal value. The air flow through test passage 31 will have a normal value corresponding to this normal pressure difference, and will in turn cool thermistor by a normal amount. The circuitry 33 will respond to the normally cooled thermistor by lighting green light 35, thereby giving an indication that vent 11 is not blocked. If, on the other hand, vent 11 is blocked, the pressure difference between passage 24 and ambient will have some value which is less than the normal amount. The resulting air flow through test passage and thermistor cooling will be correspondingly less. The circuitry 33 will respond to the condition of the less cooled thermistor to light red sight 34, thereby giving an indication that vent 11 is blocked. Test passage 31, together with thermistor 32 and circuitry thus function as a sensor of pressure difference between passage 24 and the ambient and operate a display of lights 34 and 35 to give and indication of whether there is a blockage in vent 11.

I claim:

1. A test instrument for detecting a condition of blockage in the exhaust vent of a clothes drying machine, said clothes drying machine having a lint filter removal passage terminating in a filter access port on the top of the clothes drying machine for inserting and removing for cleaning a lint filter, said test instrument comprising a body fitting such an access port of such a clothes drying machine and having dimensions such that when said body is inserted in such a port it presents a first face facing toward such a passage and a second face facing away from such a passage and blocks passage of ambient air through such a port into such a lint screen removal passage, a sensor of pressure difference mounted on said body and sensing difference of pressure between that on said first face and that on said second face, and a display connected to respond to said sensor and providing an indication of whether there is a blockage in an exhaust vent of a clothes drying machine in which said test instrument is inserted.

2. A test instrument as claimed in claim 1, wherein said sensor includes a test passage passing through said from said first face to said face and providing a passage by which ambient air may pass into such a lint screen removal passage, a thermistor emplaced within said test passage and circuitry connected to said thermistor responding to resistance changes in said thermistor to actuate signal lights indicating a condition of blockage in said exhaust vent.

3. A method for detecting a condition of blockage in an exhaust vent of a clothes drying machine, said clothes drying machine having a lint filter removal passage terminating in an access port on its top for inserting and removing for cleaning a lint filter, comprising the steps providing a test instrument comprising a body with a surface and with a peripheral seal therearound, said seal dividing said body surface into a first face and a second face, a sensor of pressure difference mounted on said body and sensing difference of pressure between that on said first face and that on said second face, and a display connected to respond to said sensor and providing an indication of whether the pressure difference between that on said second face and that on said first face is greater than a predetermined value, fitting said body into said access port of the clothes drying machine so that said seal engages said port, said first face faces into said lint filter removal passage, said second passage faces outward, and said body and seal cooperatively block flow of ambient air into said passage, putting said clothes drying machine in operation, reading said display to discriminate whether there is a blockage in an exhaust vent of the clothes drying machine.

* * * * *